US005941140A

United States Patent [19]

Suksi

[11] Patent Number: 5,941,140

[45] **Date of Patent: *Aug. 24, 1999**

[54] REVERSIBLE STEPLESS WRENCH

[75] Inventor: Paul Suksi, Colorado Springs, Colo.

[73] Assignee: Alvin C. Collins, Colorado Springs, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,986

[22] Filed: Oct. 31, 1996

[51] Int. Cl.[6] ..... B25B 13/00

[52] U.S. Cl. ..... 81/59.1; 192/44

[58] Field of Search ..... 81/59.1, 60; 192/44

[56] References Cited

U.S. PATENT DOCUMENTS

| | | |
|---|---|---|
| 4,015,935 | 4/1977 | Andersson et al. . |
| 4,051,935 | 10/1977 | Nakayama . |
| 4,457,416 | 7/1984 | Kutzler . |
| 4,669,339 | 6/1987 | Cartwright . |
| 5,086,673 | 2/1992 | Korty . |

FOREIGN PATENT DOCUMENTS

| | | | |
|---|---|---|---|
| 888494 | 12/1971 | Canada | 81/59.1 |
| PCT/US95/02117 | 2/1995 | WIPO . | |

*Primary Examiner*—James G. Smith

*Attorney, Agent, or Firm*—Pollock, Vande Sande & Amernick

[57] ABSTRACT

An elongated handle includes at one end a cylindrical housing. A drive element having a tool grasping member at one end, extends into the cylindrical housing. A plurality of camming surfaces on the drive element face an interior wall of the cylindrical housing. Two of the camming surfaces have a spring loaded ball associated therewith for dividing the camming surfaces into first and second regions. A rolling body cage extends into the cylindrical housing, equals dividing the space between the camming surfaces and interior wall into a plurality of compartments. Rolling bodies are inserted in the compartments, and are positionable by rotating the rolling body cage on either side of the spring loaded balls. Depending on the location of the rolling bodies with respect to the spring loaded ball, the direction of rotation of the wrench is controlled.

7 Claims, 2 Drawing Sheets

REVERSIBLE STEPLESS WRENCH

BACKGROUND OF INVENTION

The present invention relates to a stepless drive wrench for rotating a tool in one of two selectable directions. Specifically, a stepless reversible one-way wrench for rotating a socket is disclosed.

Ratchet handles are used by mechanics to rotate a socket which tightens a hex nut or hex screw. The selected socket is snapped into place over a tool holder, which is in turn rotated by a ratchet handle. The coupling between the tool holder and ratchet handle is such that one-way rotation of the tool is possible, while permitting rotation of the ratchet handle in the opposite direction in a decoupled state from the socket. The one-way coupling is effected either through a ratchet wheel and a pawl which engage the handle and tool holder, or in the case of stepless wrench, a reversible one-way clutch is provided between the ratchet handle and tool holder.

In the toothed ratchet wheel and pawl-type of ratchet handle, a larger amount of space is required to rotate the ratchet handle so that the pawl engages with the tool ratchet wheel. The present invention relates to a stepless wrench which can be used in confined spaces where the ratchet handle has a restricted rotational arc.

Stepless ratchet handles are known in the art, and are described in numerous references including U.S. Pat. Nos. 4,457,416, 4,669,339, 5,086,673, 4,457,416, and 4,051,935. Each of these devices includes a drive mechanism having a hexagonal rotator, which together with a surrounding wall delimits six peripherally tapered spaces. The tapered spaces are separated and includes therein a body, for engaging the rotator with the interior surface of the ratchet handle.

The difficulty with these prior art devices relates to the complexity of manufacture. The devices include not only a one-way drive mechanism, but a means to reverse the direction of the drive so that the wrench can be used in both a tightening and loosening operation.

The present invention is an improvement over the earlier devices, representing a simpler and inexpensively manufactured device.

SUMMARY OF THE INVENTION

The stepless drive wrench, in accordance with the present invention, includes an elongated handle having a housing at one end. The housing receives a drive element having a tool grasping end, which extends out of the housing for supporting a tool. The portion of the drive element within the housing has a plurality of camming surfaces about the circumference thereof. The drive element rotates about an interior axis of the housing. A spinner element closes an opposite end of the housing and is connected to the drive element. A rolling body cage between the camming surfaces and interior wall of the housing supports a plurality of rolling bodies so that a single rolling body is positioned opposite a single camming surface. Means are included on the drive clement for positioning the rolling bodies towards the same end of a respective camming surface which establishes a direction of rotation for the stepless drive wrench. Rotation of the elongated handle in one direction forces the rolling bodies which contact the interior wall of the housing into cooperation with the end of the camming surfaces, locking the elongated handle with the drive handle to rotate the drive element and tool.

The direction of rotation of the stepless drive wrench is changed by positioning the rolling bodies on the opposite end of each camming surface. Thus, rotation in the opposite direction forces the rolling bodies into engagement with the cam surfaces thereby rotating the drive element in the opposite direction.

When the elongated handle is rotated in the direction opposite the drive direction, the rolling bodies move away from an end of the camming surface, into a larger space between the camming surface and interior surface of the housing. This decouples the handle from the drive element, permitting the elongated handle to be repositioned for continuing rotation of the drive element.

In a preferred embodiment of the invention, the rolling bodies are positioned, vis-a-vis the respective end of the camming surfaces by a rolling body cage. The cage, in turn, is connected to a direction control member on the outside of the housing. By rotating the direction control member, each of the rolling bodies are moved from one end of a camming surface to the other. A pair of spring loaded balls located at the mid section of two of the camming surfaces maintain the rolling bodies at the selected end of the camming surfaces, thereby establishing a direction of rotation for the wrench.

DESCRIPTION OF THE PREFERRED EMBODIMENT

Figure 1:
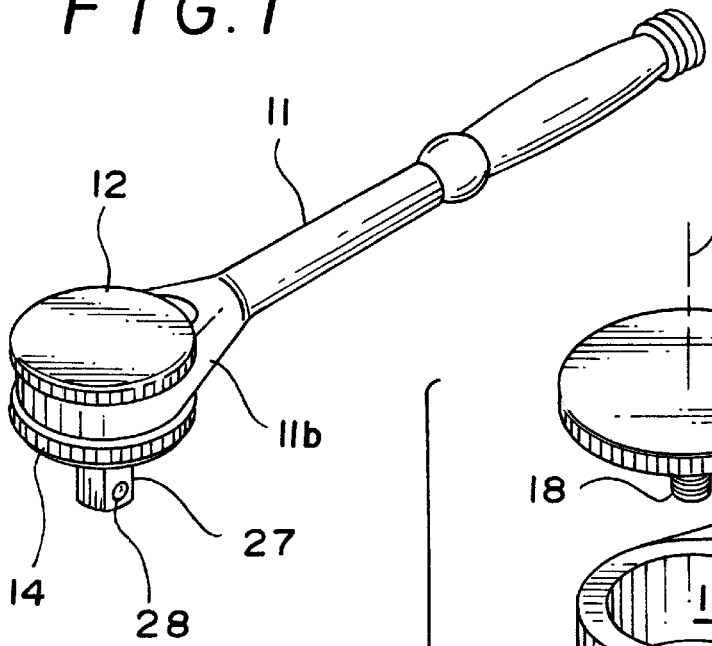
FIG. 1 is a perspective view of the stepless wrench in accordance with a preferred embodiment of the invention.
Figure 2:
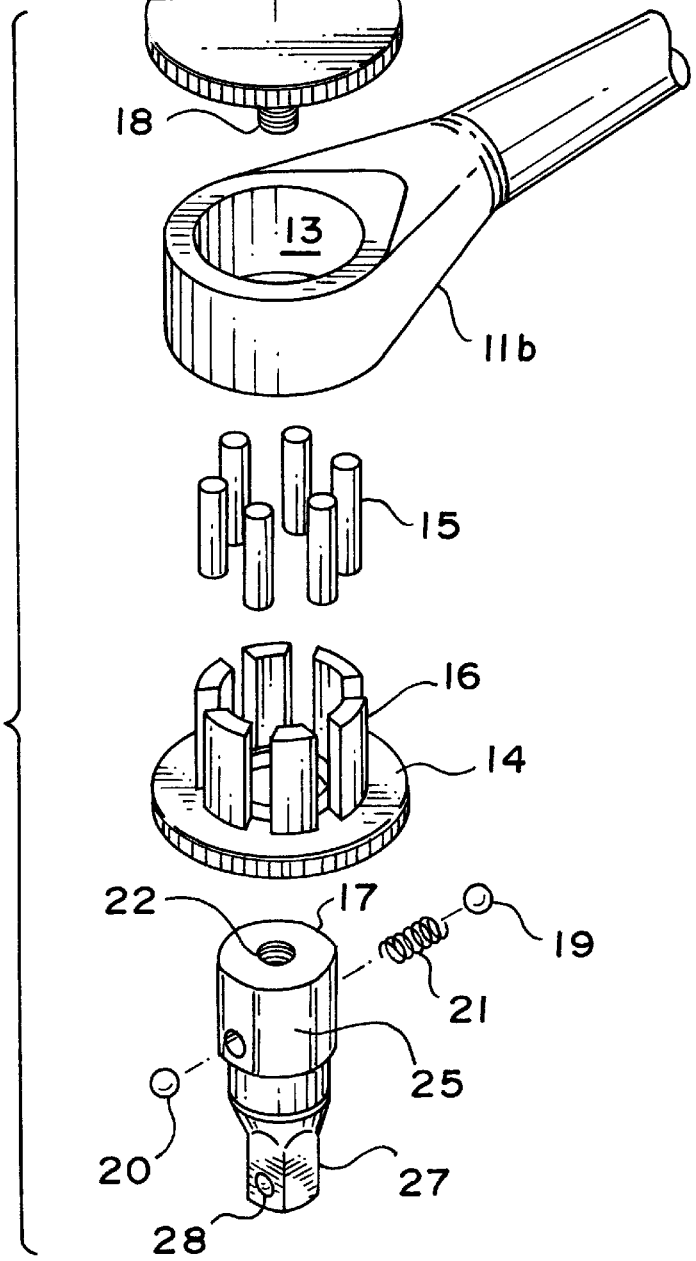
FIG. 2 is an exploded view of the stepless wrench in accordance with a preferred embodiment of the invention.

Referring, in particular, to FIGS. 1 and 2, there is shown a perspective view as well as exploded view of a stepless wrench in accordance with the preferred embodiment. The stepless wrench includes a generally elongated handle 11. At one end 11*b* of the handle 11 is a cylindrical housing 13. The cylindrical housing 13 supports a drive element 17 for rotation by the handle 11 in a selected direction. The drive element 17 includes at one end a tool grasping portion 27 which extends outside of the cylindrical housing 13. Additionally, the drive element 17 may be rotated in the selected direction by spinner 12.

The control over the direction of rotation of the drive element 17 by the spinner 12 or elongated handle 11 is effected by a direction control member 14 which can be rotated in first and second directions to select the rotation direction for the stepless wrench.

As shown in FIG. 2, the cylindrical housing 13 is closed at one end by the spinner 12, which has a threaded fastener 18 associated therewith for engaging a threaded hole 22 on the drive element 17. The direction control member 14 includes as plurality of upstanding elements 16 "connected to a common support" which equally divide the space formed between the inner wall of cylindrical housing 13 and drive element 17 into individual compartments, forming a cage for equally spacing rolling bodies 15 about the circumference of drive element 17. The rolling bodies 15 are in the form of solid cylinders and contact the inner wall of cylindrical housing 13. The direction control member 14 includes a centrally located bore through which the drive element 17 extends. The drive element 17 includes a plurality of camming surfaces 25, which cooperate with the rolling bodies 15 to couple the drive element to the wall of cylindrical housing 13 to establish a direction of rotation for the handle 11.

Figure 3:
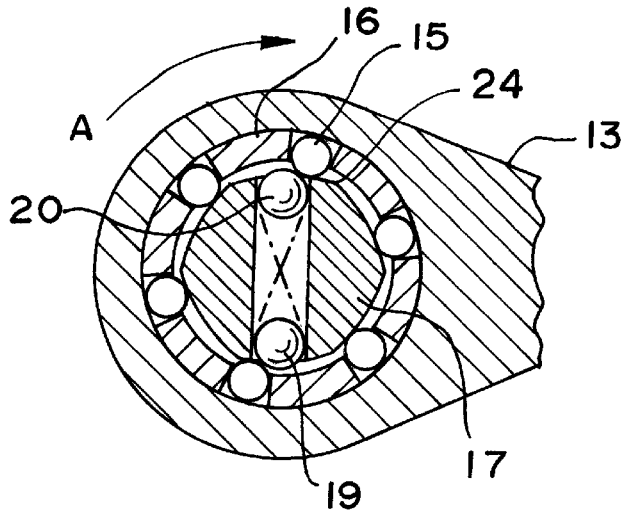
FIG. 3 is a first section view illustrating the cooperation of the rolling bodies 15 with the drive element 17 and cylindrical housing 13 in a first direction of rotation of the wrench.

Coupling between the handle 11 and the drive element 17 can be seen more particularly in FIG. 3. FIG. 3 is a section view of the cylindrical housing 13 illustrating the position of the rolling bodies 15 vis-a-vis the camming surfaces 25 on the drive element 17. A pair of spring loaded balls 19 and 20 divide two of the camming surfaces 25 along the camming surface midsection into first and second regions and maintain two respective rolling bodies 15 positioned in one of the regions of the camming surfaces 25. In the position shown, rotation of the handle 11 in the direction A engages the rolling bodies 15 with a first region of the camming surfaces 25 and with the wall of cylindrical housing 13. As the roller body cage 16 positions each of the rolling bodies 15 with respect to each other, each are biased towards the same end of a respective camming surface 25.

The partitioning of the camming surfaces 25 into first and second regions by the spring loaded balls 19 and 20, define first and second tapered spaces bounded by the camming surfaces 25 and the surface of the cylindrical housing 13. As the camming surfaces taper the space on each side of the spring loaded ball in opposite directions, a force transmission from the handle 11 to the drive element 17 in opposite directions may be effected, depending on which side of the camming surfaces 25 mid section the rolling bodies 15 are positioned.

Rolling bodies 15 are urged clock-wise when the handle 11 is rotated in the direction A. The camming surfaces 25 are curved along a radius extending through the axis of drive element 17 which facilitates movement of the rolling bodies 15 towards the end of the camming surface 25. As the space between the cylindrical housing 13 and camming surfaces 25 is decreasing in the direction of rotation, the rolling bodies 15 effectively engage the cylindrical housing wall 13*a* with one end of the camming surfaces 25. If the user rotates the handle in the counter clock-wise direction, when the rolling bodies 15 are positioned as shown in FIG. 3, the cage 16 and rolling bodies 15 are free to rotate into an increasing space between the cylindrical wall 13*a* of cylindrical housing 13 and the camming surfaces 25, effectively decoupling the drive element 17 from the handle 11.

Figure 4:
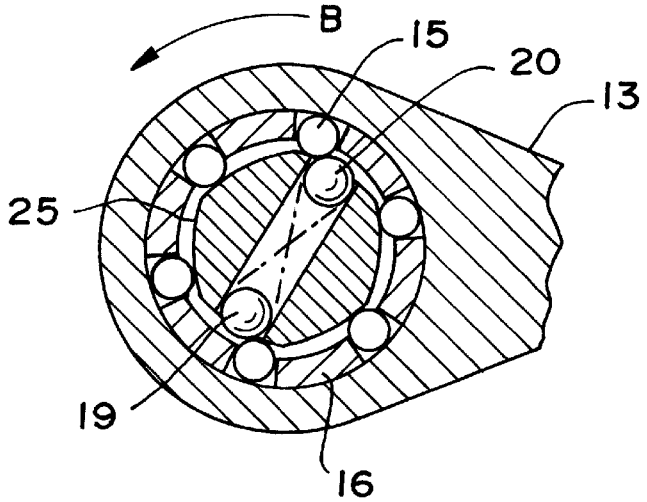
FIG. 4 is a second section view illustrating the positioning of the rolling bodies 15 with the drive element 17 in a second direction of rotation of the wrench.

FIG. 4 is a section view which shows the positioning of the cage 16 and rolling bodies with respect to the opposite end of the camming surfaces 25 for effecting rotation of the drive clement 17 in the direction B. The spring loaded balls 19 and 20 establish positions for the rolling bodies on the other side of the mid-section of each camming surface 25. When the rolling bodies 15 and cage 16 are positioned as shown in FIG. 4, rotation of the handle 11 in the counter clock-wise direction B forces the rolling bodies 11 into engagement with the opposite side of the camming surfaces 25, which form the second tapered space with the cylindrical housing wall 13*a*, which decreases in the direction B. Rotation of the handle 11 in the clock-wise direction will provide free movement between the handle 11, as the rolling bodies 15 are effectively urged in the direction of increasing space between the camming surfaces 25 and cylindrical housing 13.

Figure 5:
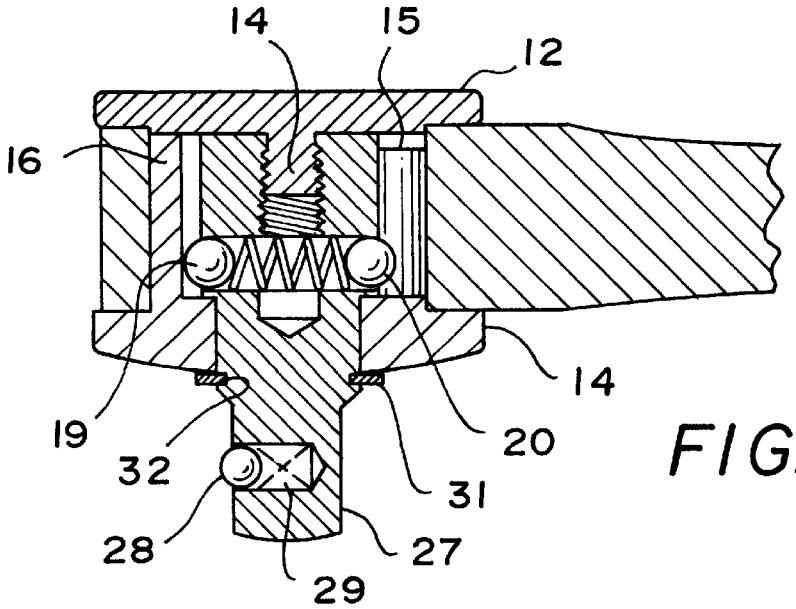
FIG. 5 is a third section view of the assembled wrench.

As illustrated in the section view of FIG. 5, the direction control member 14 is held in place and axially fixed with respect to the drive element 17 by a snap ring 31 received in a channel 32 of the drive element. The cage 16 rotates with respect to said drive element 17 and cylindrical housing 13 when the direction control member 14 is rotated, thus permitting the positioning of the rolling bodies 15 in either of the first and second positions represented by FIGS. 3 and 4 respectively. When the roller bodies 15 are repositioned to change the direction of rotation for the wrench, the spring loaded balls 19 and 20 are deflected inwardly and the rolling bodies assume a position on the opposite side of the camming surfaces.

A tool grasping portion is comprised of a series of surfaces 27 on the end of drive element 17. Associated with one of these flat surfaces is a spring loaded ball 28, which facilitates the engagement and retention of a tool slide over the exterior flat surfaces 27. As illustrated in FIG. 5, rotation of the spinner 12 can be used to rotate the drive element 17 in the selected direction only. Both the spinner 12 and direction control element 14 include serration on the circumference thereof to facilitate grasping.

Thus, there has been described a new type of stepless wrench which is controllable in first and second directions. Those skilled in the ar will recognize yet other embodiments described by the claims which follow.

What is claimed is:

1. A stepless drive wrench comprising:

an elongated handle having at one end thereof a housing;

a drive element having a tool grasping end at one end thereof, and having an opposite end extending through one end of said housing which bears a plurality of camming surfaces facing an interior wall of said housing;

a spinner element closing an end of said housing opposite said one end and connected to said drive element;

a rolling body cage in a space between said camming surfaces and said interior wall of said housing having a plurality of elements which extend vertically from a direction control member for positioning a plurality of rolling bodies so that a single rolling body is positioned opposite a single camming surface; and means on said drive element for positioning said rolling bodies towards the same end of respective camming surfaces, where by rotation of said elongated handle in one direction forces said rolling bodies into cooperation with said camming surfaces and said interior wall of said housing thereby locking said drive element and elongated handle for rotation.

2. The stepless drive wrench according to claim 1 wherein said means for positioning said rolling bodies includes a spring loaded ball on said camming surfaces.

3. A stepless drive wrench comprising:

an elongated handle having at one end a cylindrical housing;

a drive element having a tool grasping member at one end, a second end thereof extending through one end of said cylindrical housing having a plurality of camming surfaces facing an interior wall of said cylindrical housing, two of said camming surfaces having a spring loaded ball which divides said camming surfaces into first and second regions;

a spinner element closing an end of said cylindrical housing opposite said one end, and connected to said drive element for rotating said drive element; and a rolling body cage extending into said cylindrical housing, having a plurality of partition elements which vertically extend from a direction control member which closes said cylindrical housing one end, and which has a hole through which said drive element extends, which divides a space between said camming surfaces and said interior wall into a plurality of compartments which receive a plurality of rolling bodies, said compartments maintaining the rolling bodies spaced apart so that a single rolling body is positioned on a single camming surface of said drive element;

said cage positioning said rolling bodies on one or the other of said first and second regions upon rotation of said direction control member, whereby rotation of said elongated handle and drive element is fixed to rotate in one of first and second directions by said rolling bodies depending on which region said rolling bodies are located.

4. The stepless drive wrench of claim 3 wherein said rolling body cage support is axially fixed with respect to said drive element with a snap ring.

5. The stepless drive wrench of claim 4 wherein said direction control member includes a plurality of serrations about the periphery thereof for assisting in positioning said rolling bodies in one of said regions.

6. A stepless drive wrench comprising:

an elongated handle having at one end thereof a cylindrical housing;

a drive element having a tool grasping portion on one end thereof, supported for rotation about an axis of said cylindrical housing, said drive element having a plurality of camming surfaces extending within said housing, two of said camming surfaces including a spring loaded ball at the midsection thereof, dividing said camming surfaces into first and second regions which form with an interior wall with said cylindrical housing first and second oppositely tapered spaces;

a spinner element connected through said housing to said drive element; and a rolling body cage having a plurality of upstanding elements for supporting a plurality of equally spaced rolling bodies in said cylindrical housing, two of said rolling bodies being positioned by said rolling body cage in one or the other of said regions, whereby said rolling bodies in a first direction of rotation of said elongated handle are forced into said first tapered spaces to engage said drive element to rotate said drive element in a first direction, and a direction control member, supporting said upstanding elements which rotates said cage so that said two rolling bodies are positioned on one side or the other of said spring loaded balls.

7. A stepless drive wrench comprising:

an elongated handle having at one end thereof a housing;

a drive element having a tool grasping end at one end thereof, and having an opposite end extending through one end of said housing which bears a plurality of camming surfaces facing an interior wall of said housing;

a spinner element closing an end of said housing opposite said one end and connected to said drive element;

a direction control member including a central hole through which said drive element extends, closing said one end of said housing;

a rolling body cage in a space between said camming surfaces and said interior wall of said housing comprising a plurality of elements which extend vertically from said direction control member, said partition elements positioning a plurality of rolling bodies so that a single rolling body is positioned opposite a single camming surface in response to rotation of said direction control member; and means on said drive element for positioning said rolling bodies towards the same end of respective camming surfaces, where by rotation of said elongated handle in one direction forces said rolling bodies into cooperation with said camming surfaces and said interior wall of said housing thereby locking said drive element and elongated handle for rotation.

* * * * *